United States Patent [19]

Buccieri, Jr.

[11] Patent Number: 4,586,906

[45] Date of Patent: May 6, 1986

[54] LOTTERY MARKING GUIDE

[76] Inventor: Agostino R. Buccieri, Jr., 4440 Haskell Ave., Encino, Calif. 91436

[21] Appl. No.: 739,526

[22] Filed: May 31, 1985

[51] Int. Cl.[4] ..... B32B 3/24

[52] U.S. Cl. ..... 434/364; 428/13; 428/77; 428/138; 235/495; 283/903; 33/562

[58] Field of Search ..... 428/13, 14, 77, 138; 434/364; 235/495; 33/562; 283/903, 50, 1 R; 273/240, 269, 309

[56] References Cited

U.S. PATENT DOCUMENTS

| | | | |
|---|---|---|---|
| 2,525,837 | 10/1950 | Simplair | 434/364 |
| 3,089,260 | 5/1963 | Gray | 434/364 |
| 3,258,857 | 7/1966 | Behn | 434/364 |
| 4,133,536 | 1/1979 | Cole | 273/309 |

*Primary Examiner*—Alexander S. Thomas

*Attorney, Agent, or Firm*—Pastoriza, Kelly & Lowry

[57] ABSTRACT

A folder having an opaque or transparent plastic template heat sealed along one edge to an overlapping opaque plastic layer. The template is rectangular and has rows and columns of rectangular openings therethrough. A lottery card is then inserted between the template and the overlapping plastic layer. The lottery card has rows and columns of indicia outlining rectangular areas thereon, all of which may be placed in registration with the template openings. Selected areas may then be filled in by hand with a ball point pen or pencil or other writing instrument.

4 Claims, 6 Drawing Figures

FIG. 3
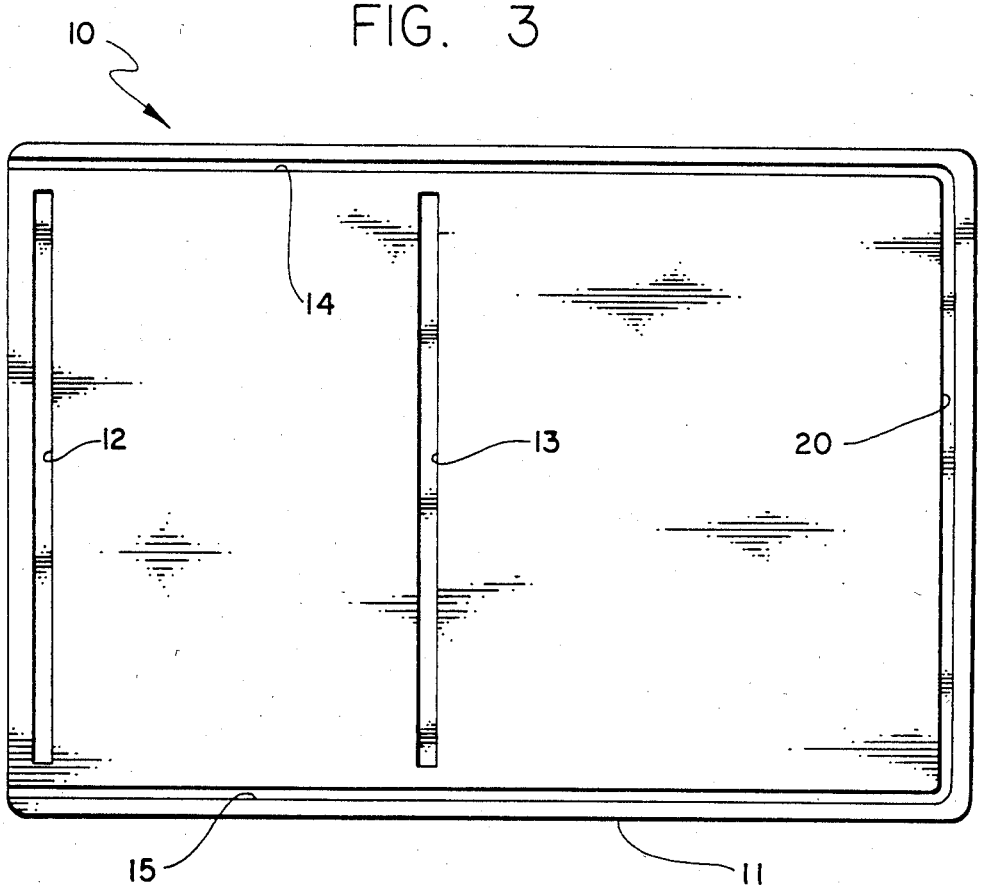
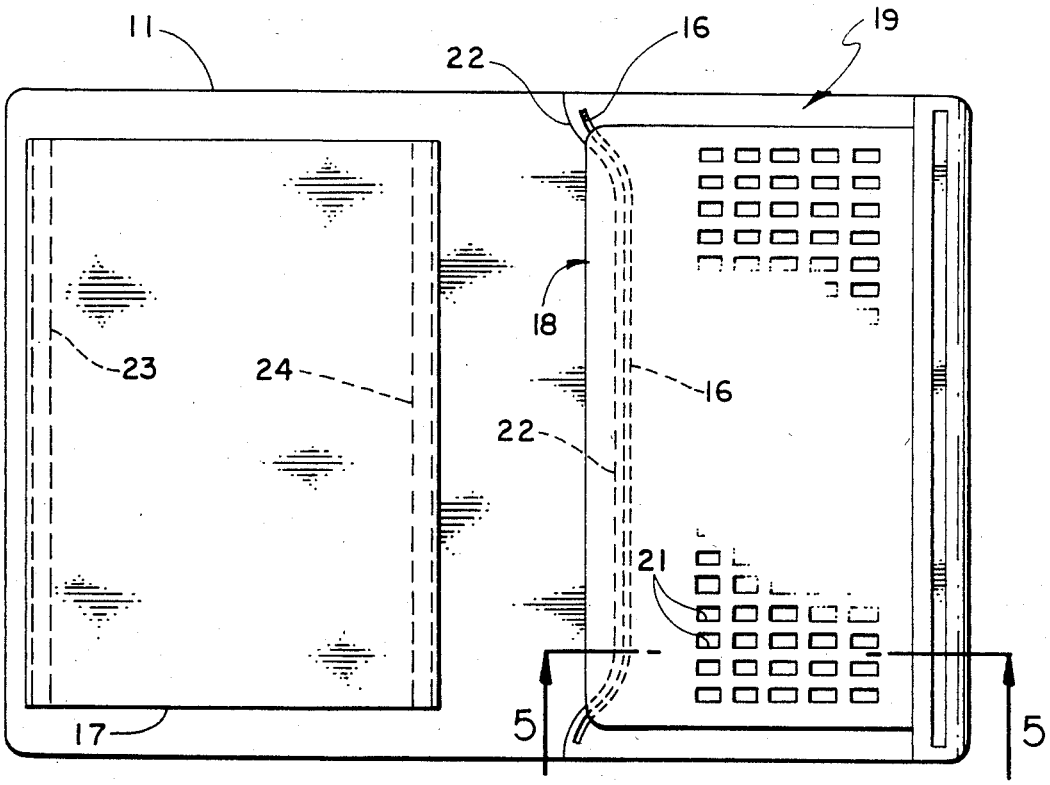
FIG. 4

LOTTERY MARKING GUIDE

BACKGROUND OF THE INVENTION

This invention relates to marking devices, and more particularly to a lottery card marking guide.

PRIOR ART STATEMENT

A search revealed the following prior art:

| INVENTOR | U.S. PAT. NO. | ISSUE DATE |
|---|---|---|
| J. I. Simplair | 2,525,837 | Oct. 17, 1950 |
| R. T. Gray | 3,089,260 | May 14, 1963 |
| W. R. Behn | 3,258,857 | Jul. 5, 1966 |
| Charles Cole | 4,133,536 | Jan. 9, 1979 |

Simplair discloses problems and solutions for marking an accounting machine card 10 with a graphite pencil 13 by the use of a template 20 having slots or openings 21 therethrough. See Col. 4, lines 68–75, and Col. 5, line 1 et seq. See especially Col. 5, lines 1–40. See also Col. 7, lines 17–54. Col. 7, lines 17–25 read as follows: "Preferably, the base plate 19 of the template is made somewhat longer than the face plate (see FIGS. 1-2-3) a feature which serves to guide the card into the pocket-like space between them. Also facilitating this entry, and at the same time helping maintain the card in proper registry with the template face perforations, is the represented undercut recess in the base plate body (see FIG. 4)."

Col. 7, lines 48–54 read as follows: "A rivet pin 26 also joins the tabs 27 of the template's plates beyond the exit aperture. This juncture serves as a barrier to stop the card at the point where the card's marking fields are aligned with the openings 21 and the template's face held thereagainst".

As shown in FIG. 4, card 10A is sandwiched inbetween template 20 and base plate 19 both of which are substantially inflexible.

Pin 26 is a rivet (Col. 7, line 48). Other unnumbered rivet pins are apparently provided at the four corners of template 20 to hold template 20 and base plate 19 in fixed positions relative to each other.

Gray discloses vertically oriented rows and columns of slots through a template 26. Col. 1, lines 64–69 read: "The guard is formed of glass or suitable plastic in the form of a flat, rectangularly shaped sheet 26, with integrally formed and downwardly extending ledges 28 at the four edges. These ledges retain the paper score sheet therebelow in position, as is more clearly shown in FIG. 2".

Behn discloses an answer sheet 18 in between apertured templates 12 and 14 and guided by walls 20, 22 and 24.

Cole discloses a bingo card holding and marking device with a transparent sheet 10 (Col. 2, line 15) having holes 12 (Col. 2, line 18) therethrough.

Six numbers must be selected, for example, for each of two or more lottery games. A number is selected by darkening a rectangular area on a lottery card on which the number is printed. The rectangular area is desirably darkened with a ballpoint pen or pencil or with some other writing instrument.

Sometimes a person may darken 60 numbers on one card. The same is then fed to a conventional machine which prints a ticket with indicia corresponding to the numbers selected. However, the rectangular areas may be imperfectly darkened. That is, there may be slopover. In this case, the machine will reject the card. It is clearly a frustrating experience for a person to work laboriously and to darken 60 small rectangular areas and have the card rejected by the ticket machine.

SUMMARY OF THE INVENTION

In accordance with the lottery marking guide of the present invention, the above-described and other disadvantages of the prior art are overcome by providing a template with rectangular apertures therethrough and means to align each of the rectangular areas of a lottery card symmetrically with a corresponding aperture and to keep each in a fixed position there while numbers are selected (rectangular areas are filled in).

The template of the present invention, which may be made of a plastic material, is heat sealed to a plastic layer or the like along a line that is aligned with the apertures. Abutment of a lottery card edge with the template and other layer of the seal line then aids in registration of the rectangular areas on the card with the template apertures.

BRIEF DESCRIPTION OF THE DRAWINGS

In the drawings, which are to be regarded as merely illustrative:

FIG. 3 is a top plan view of the guide of FIGS. 1 and 2 when in unfolded position;

FIG. 4 is a bottom plan view of the guide of FIGS. 1–3 when in unfolded position;

DESCRIPTION OF THE PREFERRED EMBODIMENT

Figure 1:
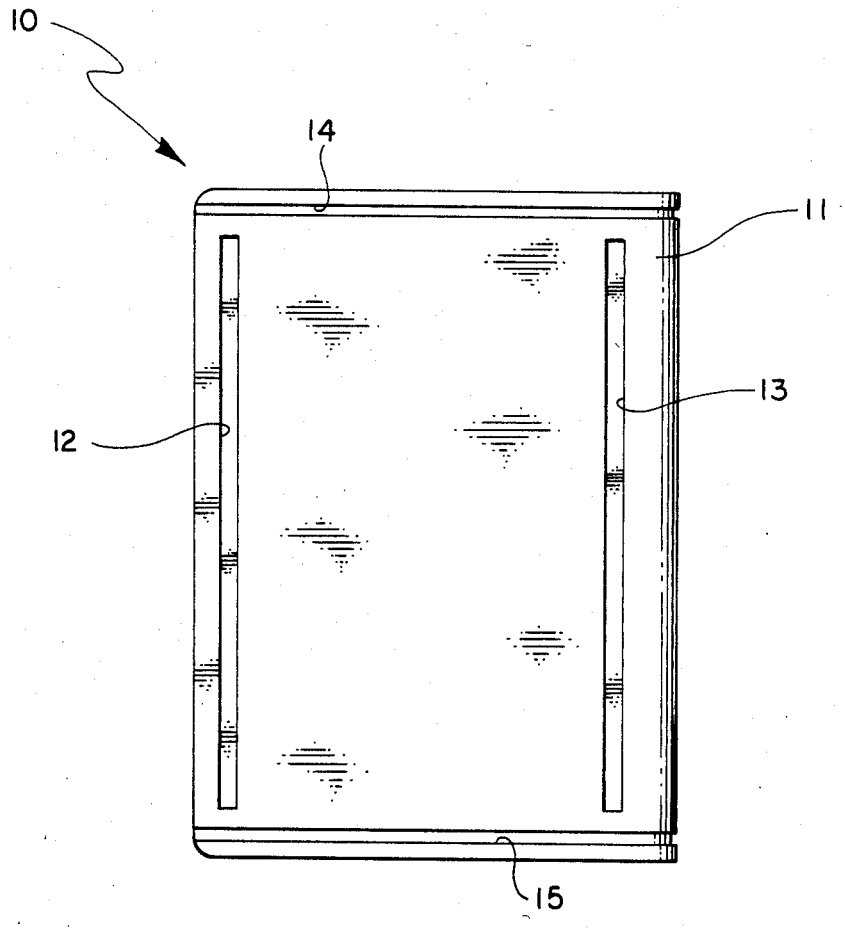
FIG. 1 is a top plan view of a lottery marking guide constructed in accordance with the present invention with the guide in folded position.
Figure 5:
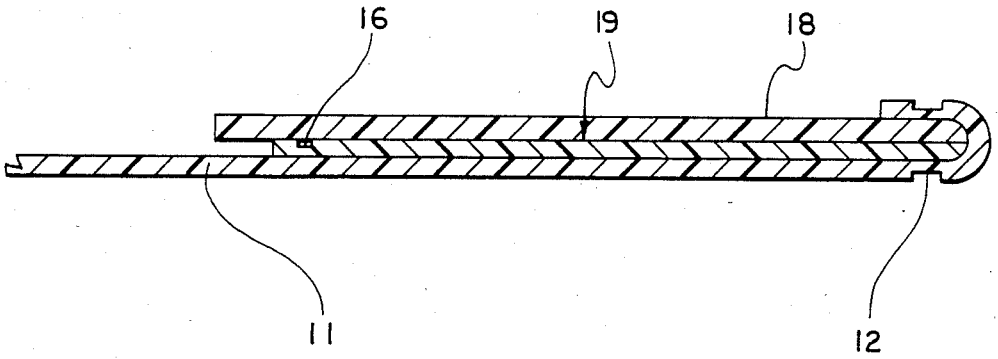
FIG. 5 is a transverse sectional view of the guide of FIG. 4 taken on the line 5—5 shown therein.

In the drawings, in FIG. 1, the lottery marking guide is shown in folded position at 10 including a cover layer 11 having depressions at 12, 13, 14 and 15 caused by heat sealing (all of the structure disclosed herein may be made of heat sealable plastic, if desired). Depressions 12–15 all have widths small in comparison to their respective lengths, as shown. The depths of depressions 13–15 and all others disclosed herein may be similar to those of depressions 12 and 16 shown in FIG. 5.

Figure 2:
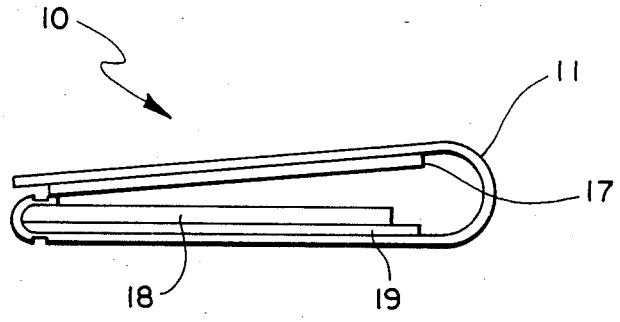
FIG. 2 is an end elevational view of the guide of FIG. 1, when in folded position.

In addition to cover layer 11 shown in FIG. 2, there are additional plastic layers 17, 18 and 19.

Figure 6:
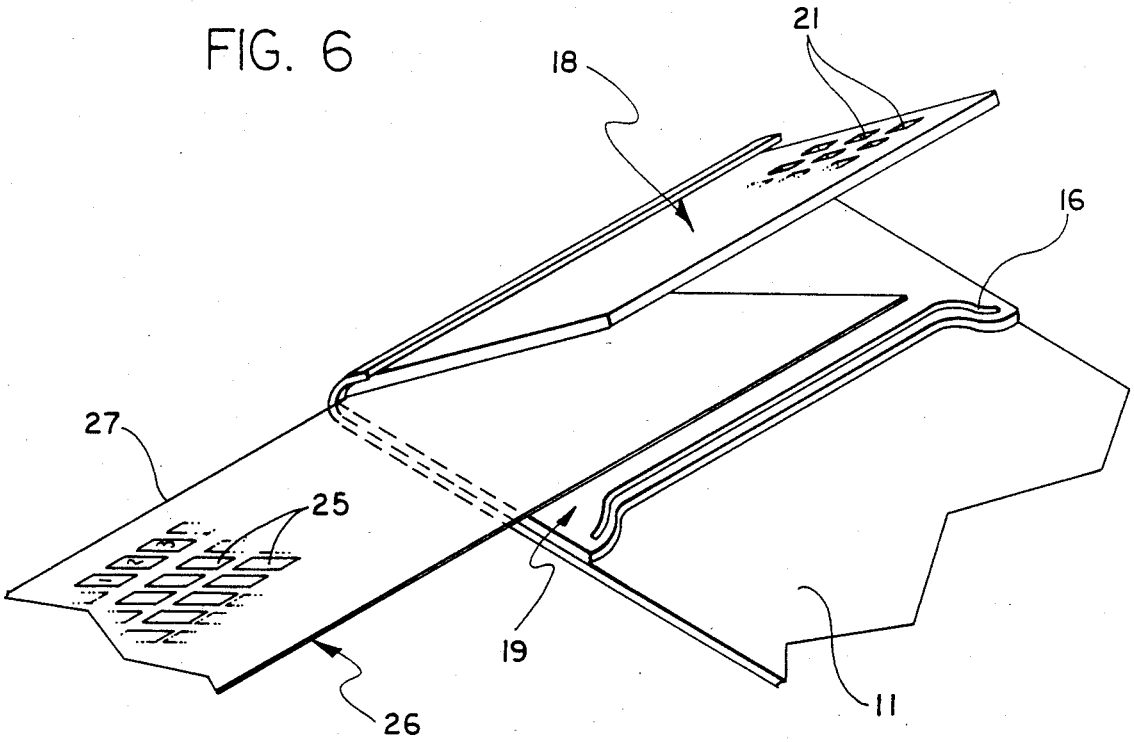
FIG. 6 is a perspective view of a portion of the guide shown in FIG. 4.

Depressions 12–15 have been omitted in FIGS. 2 and 6 for clarity.

Cover layer 11 is shown again in FIGS. 3–6. In FIG. 3, note will be taken that depressions 14 and 15 are connected by still another depression 20. (Depressions 14, 15 and 20 run around the sides of cover layer 11.)

In FIG. 4, layer 18 is a template having slots 21 in rows and columns. Layer 18 may be transparent or opaque. Cover layer 11, layer 19 and template 18 are all bonded together by a heat seal in the vicinity of depression 12.

Layer 19 is also heat sealed in the vicinity of depressions 14 and 15, but nowhere in the vicinity of edge 22. Depression 16 merely firms edge 22 and is decorative. Portions of depressions 14 and 15, and all of depression 13 may be decorative. Layer 19 and layer 17 may thus be used to carry cards. Layer 17 is transparent and is heat sealed at areas 23 and 24 to cover layer 11.

A card may be inserted between areas 23 and 24 and between cover layer 11 and layer 17.

Rectangles 25 are provided on a lottery card 26 in FIG. 6. Card 26 is inserted as shown in a position between layers 18 and 19. With template 18 and layer 19 closer together, card 26 is adjuted in position until rectangles 25 lie in registration with slots 21 in template 18. Card 26 has a lower edge 27 which is aligned with rectangles 25 and aids in registration of rectangles 25 with slots 21. That is, edge 27 can slide contiguous to the surfaces of template 18 and layer 19 near the seal line thereof and be guided at that location.

Layer 19 and cover layer 11 are less rigid than and more flexible than template 18. Layers 19 and 11 thus can be peeled back from template 18 as shown in FIG. 6 to allow card 26 to be inserted therebetween.

SUMMARY

From the foregoing, it will be appreciated that template or layer 18 may be referred to hereinafter as a "second layer" whereas layer 19 may be referred to as a "first layer".

After lottery card 26 is inserted between template 18 and first layer 19, from the position shown in FIG. 6, the template 18 and first layer 19 are pushed together so as to sandwich lottery card 26 therebetween. Rectangles 25 or selected ones of rectangles 25 are then filled in on card 26 through rectangular openings 21 in template 18.

As is conventional, rectangles 25 of lottery card 26 each may have a different number associated therewith and printed on the card 26 at a location within the rectangle or immediately adjacent the rectangle.

It is an outstanding feature of the present invention that both cover layer 11 and first layer 19 of the lottery marking guide of the present invention disclosed herein are substantially more flexible and perhaps thinner than the template 18.

The lottery marking guide of the present invention can be the size of a full size gaming card or abbreviated size which would require the template to be moved in order to fully mark the card. This would facilitate being carried.

A typical lottery marking guide constructed in accordance with the present invention may sometimes be approximately 0.04" thick and made of a plexiglass-like material which is opaque or transparent. When opaque, the gaming card, when placed under the template, exposes only the numbers. This may avoid confusion when marking.

The lottery marking guide of the present invention may comprise a template with holes 8/64"×14/64" with very slight corner radii (for strength). Adjacent holes may be spaced apart 3/64" horizontally and 3/64" vertically.

Overall template dimensions can be up to eight inches horizontally (which will accommodate the New York State gaming card) by $3\frac{1}{4}$" vertically, or can be cut to as little as $3\frac{1}{2}$"×$3\frac{1}{4}$" for a smaller marking "hip-pocket" type template. In the case of the Pennsylvania gaming card, the template dimensions may be 7"×$3\frac{1}{4}$". The larger size (New York State) template can be used for the other states smaller gaming cards because the configuration of the numbered rectangles is the same.

What is claimed is:

1. A marking guide comprising:

a first rectangular layer having a predetermined width and a predetermined length both large in comparison to its thickness;

a second rectangular layer having a width and length approximately the same as said predetermined width and said predetermined length respectively, said second layer width and length also being large in comparison to its thickness, said first layer including a backing having one edge along the length thereof bonded to one edge of said first layer; and a rectangular lottery card removably sandwiched in between said first and second layers;

said lottery card having an obverse face with indicia thereon including rectangles identifiable with respective numbers, said second layer having a plurality of rows and columns of slots therethrough, said lottery card rectangles lying in registration with said second layer slots, said second layer being more rigid than said first layer so as to guide manual movement of a pen or pencil in selected second layer slots and thereby to assist in filling in predetermined ones of said lottery card rectangles, said first layer being more flexible than said second layer so as to permit peeling back said first layer to insert and to retrieve said lottery card into and from the space between said first and second layers, said first and second layers being unbonded to each other around three edges so as to permit the said peeling back of said first layer.

2. The invention as defined in claim 1, wherein:

said second layer is transparent.

3. The invention as defined in claim 2, wherein:

said first and second layers are made of plastic, said one edge of said first layer being heat sealed to said one edge of said second layer to bond the same together thereat along a line.

4. A marking guide comprising:

a first rectangular layer having a predetermined width and a predetermined length both large in comparison to its thickness;

a second rectangular layer having a width and length approximately the same as said predetermined width and said predetermined length respectively, said second layer width and length also being large in comparison to its thickness;

said first layer including a backing having one edge along the length thereof bonded to one edge of said first layer;

a rectangular lottery card removably sandwiched in between said first and second layers, said lottery card having an obverse face with indicia thereon including rectangles identifiable with respective numbers, said second layers having a plurality of rows and columns of slots therethrough, said lottery card rectangles lying in registration with said second layer slots, said second layer being more rigid than said first layer so as to guide manual movement of a pen or pencil in selected second layer slots and thereby to assist in filling in predetermined ones of said lottery card rectangles, said first layer being more flexible than said second layer so as to permit peeling back said first layer to insert and to retrieve said lottery card into and from the space between said first and second layers, said first and second layers being unbonded to each other around three edges so as to permit the said peeling back of said first layer, said second layer being opaque, said first and second layers being made of plastic, said one edge of said first layer being heat sealed to said one edge of said second layer to bond the same together thereat along a line;

an opaque plastic cover layer heat sealed to said first layer along the same line as that on which said first and second layers are heat sealed together, said first layer being heat sealed at two edges contiguous to said line to said plastic cover layer, said first layer being unbonded at one edge to permit lottery cards to be inserted between said first layer and said plastic cover layer, said first layer being bonded to an inside surface of said plastic cover layer; and a third rectangular plastic layer heat sealed along each lengthwise edge thereof to said plastic cover inside surface in a position parallel to but spaced from said first layer, said third layer lengthwise edges being parallel to said line, said third layer having parallel edges along the width thereof unbonded to said plastic cover layer to receive cards slidable between said third layer and said plastic cover layer, said plastic cover layer being made of a soft flexible plastic material to fold so that the same may be carried in a pocket, aid in registration of said lottery card rectangles with said slots being provided by an aligned edge of said lottery card to abut said first and second layers near where they are bonded together.

* * * * *